US011413637B2

(12) United States Patent
Petit

(10) Patent No.: US 11,413,637 B2
(45) Date of Patent: Aug. 16, 2022

(54) FLUID PRODUCT DISPENSING DEVICE

(71) Applicant: APTAR FRANCE SAS, Le Neubourg (FR)

(72) Inventor: Ludovic Petit, Vitot (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 17/251,369

(22) PCT Filed: Jun. 11, 2019

(86) PCT No.: PCT/FR2019/051409
§ 371 (c)(1),
(2) Date: Dec. 11, 2020

(87) PCT Pub. No.: WO2019/239058
PCT Pub. Date: Dec. 19, 2019

(65) Prior Publication Data

US 2021/0252538 A1 Aug. 19, 2021

(30) Foreign Application Priority Data

Jun. 13, 2018 (FR) ..... 1855168

(51) Int. Cl.
*B05B 11/00* (2006.01)
*B65D 83/20* (2006.01)
*B65D 83/38* (2006.01)

(52) U.S. Cl.
CPC ..... *B05B 11/3057* (2013.01); *B05B 11/0038* (2018.08); *B65D 83/206* (2013.01); *B65D 83/386* (2013.01)

(58) Field of Classification Search
CPC ..... B05B 11/3057; B05B 11/0038; B65D 83/206; B65D 83/386
See application file for complete search history.

(56) References Cited

U.S. PATENT DOCUMENTS 3,739,941 A 6/1973 Ostrwosky et al.
6,338,422 B1 * 1/2002 DeJonge ..... B05B 11/3056 222/162

(Continued)

FOREIGN PATENT DOCUMENTS

DE 196 10 456 A1 9/1997
EP 1 170 061 A2 1/2002

(Continued)

OTHER PUBLICATIONS

International Search Report for PCT/FR2019/051409, dated Nov. 6, 2019.

(Continued)

*Primary Examiner* — Frederick C Nicolas
(74) *Attorney, Agent, or Firm* — Sughrue Mion, PLLC

(57) ABSTRACT

A fluid dispenser device having a body, a reservoir including a neck, a dispenser member mounted on the reservoir, a lateral actuator system secured to the body and including a lever pivotally mounted, and a transverse projection formed directly on the reservoir and formed on or below the neck and co-operating, during actuation, with the lateral actuator system. The reservoir includes two parallel transverse projections that extend in symmetrical manner respectively on either side of the reservoir, a radial recess being defined between the two parallel transverse projections, the radial recess co-operating with the body so as to guide the reservoir axially during actuation.

9 Claims, 1 Drawing Sheet

(56) References Cited

U.S. PATENT DOCUMENTS

| | | | | |
|---|---|---|---|---|
| 6,860,411 | B2 * | 3/2005 | Stradella | B05B 11/0032 222/321.8 |
| 7,108,159 | B2 * | 9/2006 | Stradella | A61M 15/0065 222/162 |
| 8,062,264 | B2 * | 11/2011 | Godfrey | A61M 15/009 604/181 |
| 8,147,461 | B2 * | 4/2012 | Bonney | B05B 11/3059 604/187 |
| 8,347,879 | B2 * | 1/2013 | Davies | A61M 15/08 128/200.23 |
| 8,511,515 | B2 * | 8/2013 | Lemaner | B05B 11/3056 222/162 |
| 8,752,543 | B2 * | 6/2014 | Davies | A61M 15/009 128/200.14 |
| 9,050,433 | B2 * | 6/2015 | Lamble | B05B 11/3057 |
| 9,156,048 | B2 * | 10/2015 | Le Maner | B05B 11/3056 |
| 10,486,177 | B2 * | 11/2019 | Park | B05B 11/0038 |
| 2006/0118578 | A1 * | 6/2006 | Mineau | B65D 83/203 222/182 |
| 2007/0138207 | A1 * | 6/2007 | Bonney | B05B 11/3056 222/162 |
| 2007/0164049 | A1 * | 7/2007 | Bonney | B05B 11/309 222/162 |
| 2008/0116223 | A1 * | 5/2008 | Stradella | B05B 11/3059 222/162 |
| 2008/0210230 | A1 * | 9/2008 | Lintern | A61M 15/0068 128/200.23 |
| 2009/0140008 | A1 * | 6/2009 | Welp | B05B 11/0032 222/182 |
| 2010/0308082 | A1 * | 12/2010 | Lamble | B05B 11/3074 222/162 |
| 2011/0062188 | A1 * | 3/2011 | Lemaner | B05B 11/3057 222/162 |
| 2011/0094506 | A1 * | 4/2011 | Petit | B65D 83/386 128/200.14 |

FOREIGN PATENT DOCUMENTS

| | | | |
|---|---|---|---|
| FR | 2812826 | A1 | 2/2002 |
| WO | 01/03851 | A1 | 1/2001 |
| WO | 02/20168 | A1 | 3/2002 |
| WO | 03/095007 | A2 | 11/2003 |
| WO | 2005/075105 | A1 | 8/2005 |
| WO | 2006/109021 | A1 | 10/2006 |
| WO | 2009/068877 | A1 | 6/2009 |
| WO | 2009/153512 | A1 | 12/2009 |

OTHER PUBLICATIONS

International Preliminary Report on Patentability dated Dec. 17, 2020, in Application No. PCT/FR2019/051409.

* cited by examiner

FLUID PRODUCT DISPENSING DEVICE

CROSS REFERENCE TO RELATED APPLICATIONS

Field of Invention

This application is a National Stage of Application No. PCT/FR2019/051409 filed Jun. 11, 2019, claiming priority based on French Patent Application No. 1855168 filed Jun. 13, 2018.

The present invention relates to a fluid dispenser device, and more particularly to a nasal-spray device for a pharmaceutical.

Background

Fluid dispenser devices are well known in the state of the art. They generally include a reservoir containing the fluid, on which reservoir there is assembled a dispenser member, e.g. a pump or a valve, that is generally actuated by means of a dispenser head for selectively dispensing the fluid contained inside said reservoir. The dispenser head includes a dispenser orifice through which the fluid is sprayed, e.g. into the user's nose for a nasal-spray device. Numerous devices of this type are actuated manually by the user by moving the reservoir and the dispenser head axially against each other, thereby actuating the dispenser member. However, this type of device presents drawbacks, in particular when the device is of the nasal-spray type, since the axial force exerted by the user in order to actuate the device leads to a risk of the dispenser head moving inside the user's nostril, with risks of injury and/or of the fluid not being dispensed completely or properly on actuation. In order to remedy this problem, lateral actuator devices have been proposed, generally including a lever that is pivotally mounted on a body and that has an inner portion that is adapted to co-operate with one of the dispenser head and the reservoir so as to move said element against the other, and thus actuate the dispenser member. However, such devices are generally quite complex and include a large number of component parts, thereby making manufacture and assembly relatively costly. In addition, the interface between the lateral actuator system and the dispenser member for transforming the radial movement of the actuator system into axial movement of the dispenser member so as to perform actuation, is often complex and a source of malfunctions.

Documents DE 196 10 456, WO 02/20168, FR 2 812 826, U.S. Pat. No. 3,739,941, WO 01/03851, WO 03/095007, WO 2005/075105, WO 2006/109021, WO 2009/153512, WO 2009/068877, and EP 1 170 061 describe prior-art devices.

An object of the present invention is to provide a fluid dispenser device that does not have the above-mentioned drawbacks.

Non-Limiting Objects of the Invention

Another object of the present invention is to provide a fluid dispenser device, in particular a nasal spray, that guarantees safe and reliable actuation of the device on each actuation, without risk of injury to the user.

More particularly, an object of the present invention is to provide a fluid dispenser device that is simple and inexpensive to manufacture and to assemble.

The present invention thus provides a fluid dispenser device comprising: a body; a reservoir, in particular made of glass, said reservoir including a neck; a dispenser member, such as a pump or a valve that is mounted on said reservoir; a lateral actuator system that is secured to said body, said lateral actuator system including a lever that is mounted to pivot on said body; said device including at least one transverse projection that is formed directly on said reservoir, said at least one transverse projection being formed on or below said neck of the reservoir and co-operating, during actuation, with said lateral actuator system, in particular with said lever; said reservoir including two parallel transverse projections that extend in symmetrical manner respectively on either side of said reservoir, a radial recess being defined between said two parallel transverse projections, said radial recess co-operating with said body so as to guide said reservoir axially during actuation.

Advantageously, each transverse projection has a rounded surface that co-operates with said lateral actuator system, in particular with said lever.

Advantageously, said at least one transverse projection is integrally molded with said reservoir.

Advantageously, said dispenser member is a pump including a piston that slides in a pump body.

These and other characteristics and advantages appear more clearly from the following detailed description, given by way of non-limiting examples, and with reference to the accompanying drawing, and in which:

DESCRIPTION OF NON-LIMITING EMBODIMENTS OF THE INVENTION

Figure 1:
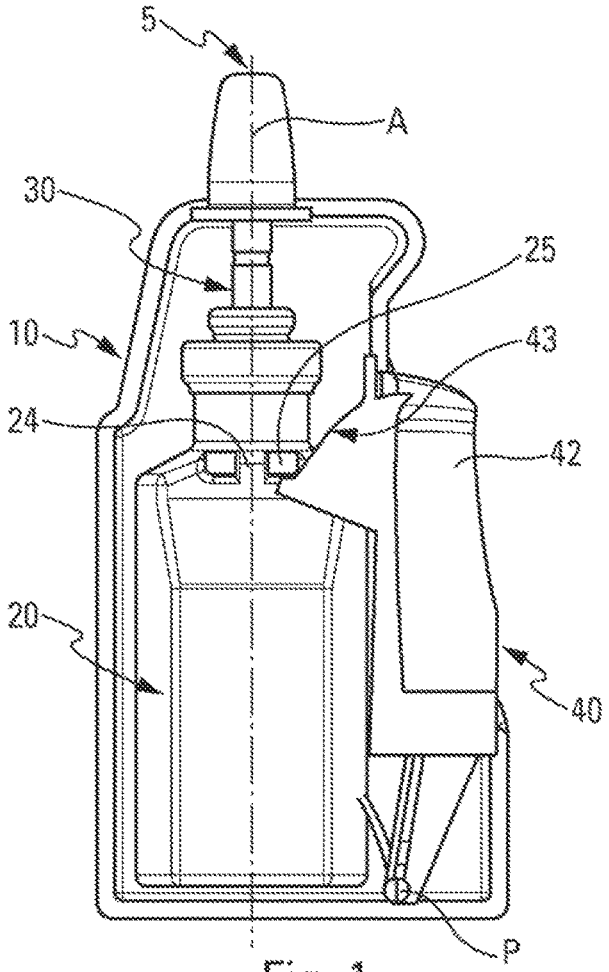
FIG. 1 is a diagrammatic section view of a device in an advantageous embodiment, shown in its rest position.
Figure 2:
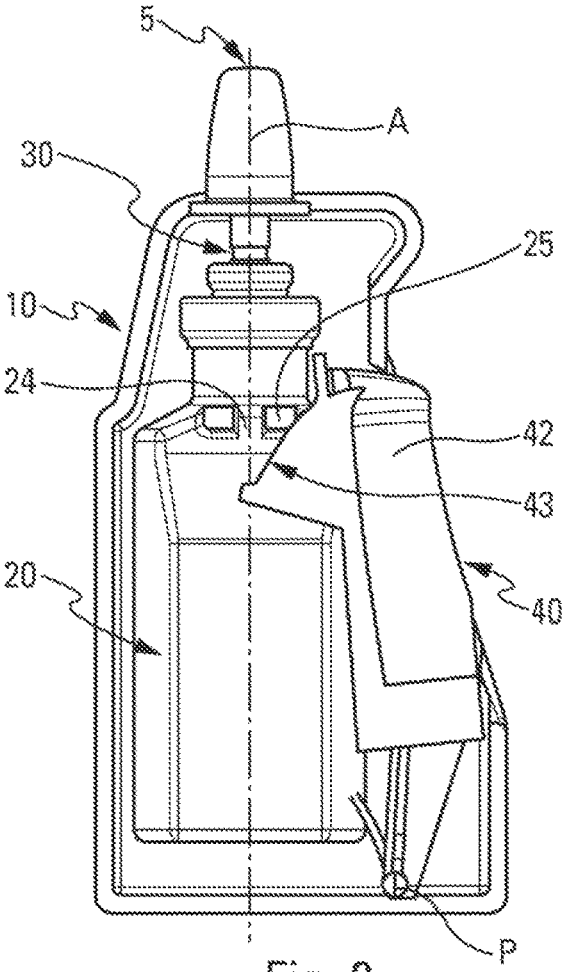
FIG. 2 is a view similar to the view in FIG. 1, shown in the actuated position.

In the description, the terms "axial", "transverse", and "radial" are relative to the longitudinal axis A shown in FIGS. 1 and 2.

The fluid dispenser device shown in FIGS. 1 and 2 includes a body 10 that advantageously incorporates a dispenser orifice 5. In a variant, the dispenser orifice may be formed in a dispenser head that is assembled on and fastened to said body.

Inside the body there is arranged a reservoir 20 containing a fluid to be dispensed. A dispenser member 30, in particular a pump or a valve, is assembled on the neck 21 of the reservoir 20 in known manner, in particular by means of a fastener ring. The unit formed by the reservoir 20 and by the dispenser member 30 is capable of being moved axially inside the body 10 during actuation, so as to dispense a dose of fluid through the dispenser orifice 5.

The dispenser member 30 is advantageously a pump including a piston that slides in a pump body. The structure of such a dispenser member is well known and is thus not shown in greater detail in the figures, in particular for the purpose of clarity.

In order to actuate the device, the body 10 includes a lateral actuator system 40. The lateral actuator system may advantageously include a lever 42 that is mounted to pivot on the body 10 about a pivot axis P, said lever 42 co-operating, during actuation, with the unit that is formed by the reservoir 20 and by the dispenser member 30.

The lateral actuator system 40 co-operates with at least one transverse projection 25 that is formed directly on the reservoir 20, on or below the neck 21 of the reservoir, e.g. during molding of said reservoir 20.

In the embodiment shown, at least one transverse projection 25 co-operates directly with a cam surface 43 of said lever 42. In a variant, a movable element could be provided that is mounted to pivot inside said lever 42, and that could co-operate with at least one transverse projection 25 of the reservoir 20.

In the invention, said reservoir 20 includes two parallel transverse projections 25 that extend in symmetrical manner respectively on either side of said reservoir 20. This configuration makes it possible to offset said transverse projections on either side of the longitudinal axis A, thereby firstly reducing the dimensions of said lever 42, and secondly avoiding having to orientate the reservoir 20 during assembly. Another advantage of this configuration is that it enables the reservoir 20 to be guided axially during its movement, using the radial recess 24 that is defined between the two parallel transverse projections 25. Such guiding may in particular be performed by an appropriate profile that is provided in the body 10.

Figure 3:
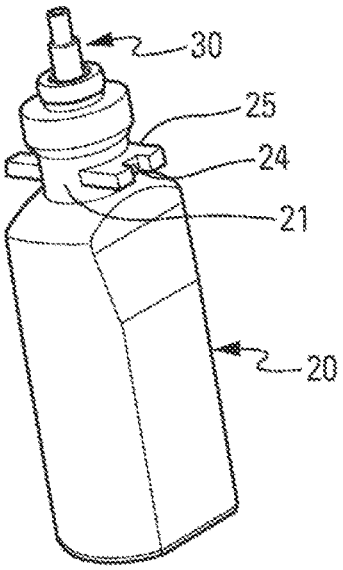
FIG. 3 is a perspective view of an assembly formed by a pump assembled on a reservoir, in a first variant of the embodiment in FIGS. 1 and 2.
Figure 4:
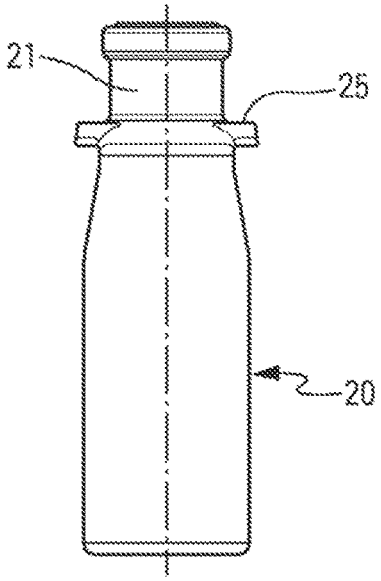
FIGS. 4 and 5 are diagrammatic section views respectively on two perpendicular section planes of a reservoir in a second variant of the embodiment in FIGS. 1 and 2.
Figure 5:
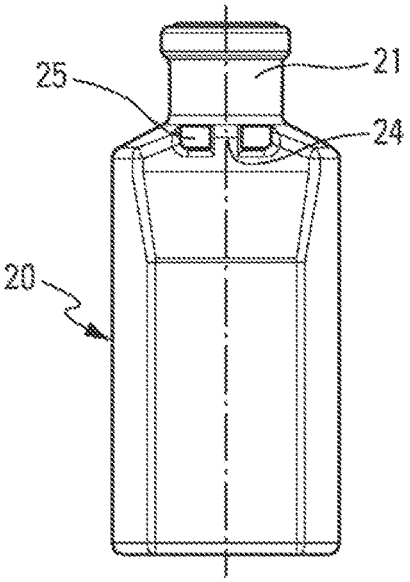

In a first variant that is shown in FIG. 3, the transverse projections 25 are arranged on the neck 21 of the reservoir 20. In a second variant that is shown in FIGS. 4 and 5, the transverse projections 25 are arranged just below said neck 21, when in the upright position of the figures.

Preferably, the reservoir 20 is made of glass, such that each transverse projection 25, also made of glass, presents a coefficient of friction that is favorable on contact with the lateral actuator system 40, in particular on contact with the lever 42. This avoids having to treat said at least one transverse projection 25 with silicone, as is generally necessary when friction occurs between one plastics part and another plastics part.

Advantageously, each transverse projection 25 has a rounded contact surface that co-operates with the cam surface 43 of the lever 42.

The present invention thus makes it possible not only to reduce the number of components by eliminating at least the fitted ring provided in order to co-operate with the lateral actuator system, but also to simplify the assembly method by eliminating the silicone-treatment step that is necessary with such a fitted ring.

Although the invention is described above with reference to several variant embodiments thereof, it is clear that any useful modification could be applied thereto by a person skilled in the art, without going beyond the ambit of the present invention, as defined by the accompanying claims.

The invention claimed is:

1. A fluid dispenser device comprising: a body; a reservoir including a neck; a dispenser member that is mounted on said reservoir; a lateral actuator system that is secured to said body, said lateral actuator system including a lever that is mounted to pivot on said body; said device including at least one transverse projection that is formed directly on said reservoir, said at least one transverse projection being formed on or below said neck of the reservoir and co-operating, during actuation, with said lateral actuator system; said device being wherein each side of said reservoir includes two axially coplanar parallel transverse projections that extend in symmetrical manner, a radial recess being defined on each side of said reservoir between said two parallel transverse projections, said radial recess co-operating with said body so as to guide said reservoir axially during actuation.

2. The device according to claim 1, wherein each transverse projection has a rounded surface that co-operates with said lateral actuator system.

3. The device according to claim 1, wherein said at least one transverse projection is integrally molded with said reservoir.

4. The device according to claim 1, wherein said dispenser member is a pump including a piston that slides in a pump body.

5. The device according to claim 1, wherein the dispenser member is a pump or a valve.

6. The device according to claim 1, wherein the reservoir is made of glass.

7. The device according to claim 1, wherein said at least one transverse projection co-operates, during actuation, with the lever of the lateral actuator system.

8. The device according to claim 1, wherein each transverse projection has a rounded surface that co-operates with the lever of the lateral actuator system.

9. The device according to claim 1, wherein the two axially coplanar parallel transverse projections extend in a same plane orthogonal to an axis along which the reservoir is guided axially during actuation.

* * * * *